US011543177B2

(12) United States Patent
Ji et al.

(10) Patent No.: US 11,543,177 B2
(45) Date of Patent: Jan. 3, 2023

(54) FREEZER FRAME WITH LOW TEMPERATURE AND HEATED PARTS

(71) Applicants: Self Electronics Co., Ltd., Zhejiang (CN); Wanjiong Lin, Zhejiang (CN); Self electronics USA Corporation, Norcross, GA (US)

(72) Inventors: Feng Ji, Zhejiang (CN); Zhaoyong Zheng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 207 days.

(21) Appl. No.: 16/900,429

(22) Filed: Jun. 12, 2020

(65) Prior Publication Data

US 2021/0180859 A1 Jun. 17, 2021

(30) Foreign Application Priority Data

Dec. 16, 2019 (CN) ..... 201911291696.7

(51) Int. Cl.

| | |
|---|---|
| ***F25D 31/00*** | (2006.01) |
| ***F25D 11/02*** | (2006.01) |
| ***F25D 21/00*** | (2006.01) |
| ***F25D 23/02*** | (2006.01) |
| ***F25D 27/00*** | (2006.01) |

(52) U.S. Cl.

CPC ..... *F25D 31/005* (2013.01); *F25D 11/02* (2013.01); *F25D 21/00* (2013.01); *F25D 23/028* (2013.01); *F25D 27/00* (2013.01); *F25D 2327/00* (2013.01); *F25D 2400/02* (2013.01); *F25D 2700/06* (2013.01)

(58) Field of Classification Search

CPC ..... F25D 21/00; F25D 23/028; F25D 27/00; F25D 2327/00; F25D 2400/02; F25D 21/04; A47F 3/001; A47F 3/043; A47F 11/10; A47B 2220/0075

USPC ..... 62/248

See application file for complete search history.

(56) References Cited

U.S. PATENT DOCUMENTS

2008/0007945 A1* 1/2008 Kelly ..... F25D 21/04 362/218
2011/0304253 A1* 12/2011 Howington ..... F25D 27/00 312/405
2019/0274451 A1* 9/2019 Twohy ..... A47F 3/04

* cited by examiner

*Primary Examiner* — Steve S Tanenbaum
(74) *Attorney, Agent, or Firm* — Wang Law Firm, Inc.

(57) ABSTRACT

The invention discloses a freezer frame comprising a frame body, the frame body includes a low-temperature part and a heating part, and a panel installed in cooperation with the frame is provided on the heating part, characterized in that, a light source is provided on the low-temperature part, and a heat conduction channel is provided between the light source and the heating part. The freezer frame and the freezer of the present invention use the heat of the light source for lighting to heat the panel to prevent the panel from fogging and generating condensed water, prevent the freezer door and frame from freezing, and simplify the structure to reduce energy consumption and manufacturing costs.

12 Claims, 4 Drawing Sheets

FREEZER FRAME WITH LOW TEMPERATURE AND HEATED PARTS

RELATED APPLICATION

This application claims priority to a Chinese Patent Application No. CN 201911291696.7, filed on Dec. 16, 2019.

FIELD OF THE TECHNOLOGY

The present invention relates to the field of freezer lighting technology, with particular emphasis on a freezer frame and a freezer.

BACKGROUND OF THE INVENTION

Freezer is another name for refrigerator and refrigerated cabinet. Generally, it includes the heat preservation body and the freezer door for opening and closing refrigerator. The internal space of the freezer is formed by the frame, panel and door. In commercial refrigerators, it is often necessary to provide transparent panels and internal lighting in the refrigerator to facilitate the display of goods. According to the height, this type of commercial refrigerator can be divided into vertical and horizontal cabinets. Among them, generally, the vertical cabinet has one side fully open and has a glass door that can be opened. In order to install the glass door and the panel, a frame needs to be set. In addition, in the form of a double door, a vertical frame is also set in the middle; the horizontal cabinet is generally open at the top and equipped with a glass door that can be opened. Sometimes, the four sides are also set as transparent panels. At this time, it needs to install a frame to install these doors and panels. Similarly, in the form of multiple doors, a horizontal frame will also be set in the middle.

In the present invention, the above-mentioned frames, vertical frames, and horizontal frames are collectively referred to as a frame. The frame and panel, as well as the frame and glass doors, can be detachable, for example, when the glass door can also be fixed like the side wall panel in the cabinet, which is related to the installation position and installation method. The lighting fixture is generally installed on the inner side of the frame (the side facing the interior of the freezer). In order to prevent of the transparent plate on the door and the panel from fogging to generate condensate and prevent the door and the frame from freezing, in the prior art, a heating device is generally added to the frame to avoid the above problems. The heating device commonly uses an electric heating wire, which causes energy consumption.

BRIEF SUMMARY OF THE INVENTION

In view of this, the present invention provides a freezer frame and a freezer to reduce the overall energy consumption of the freezer.

A freezer frame comprising a frame body, the frame body includes a low-temperature part and a heating part, and a panel installed in cooperation with the frame is provided on the heating part, characterized in that, a light source is provided on the low-temperature part, and a heat conduction channel is provided between the light source and the heating part.

the freezer frame further comprises a heat insulation part provided on the frame body.

the heat insulation part comprises a low-temperature and heat-insulating member covering at least a partial area of the low-temperature part.

the heat insulation part comprises a light-transmitting and heat-insulating member located in the light emitting direction of the light source.

the light-transmitting and heat-insulating member is disposed on the low-temperature part.

the heat insulation part comprises a low-temperature and heat-insulating member covering at least a part of the low-temperature part, the light-transmitting and heat-insulating member is disposed on the low-temperature and heat-insulating member.

the light-transmitting and heat-insulating member comprises a light-transmitting cover disposed upon the light source and a heat insulation space between the light-transmitting cover and the light source.

the low-temperature and heat-insulating member comprises a heat insulating plate which is provided on the low-temperature part.

the heat insulating plate is spaced apart from the low-temperature part, and the space between them is filled with porous material.

the outer surface of the low-temperature and heat-insulating member is provided with a light shield located on the periphery of the light source.

the low-temperature part is provided with a lamp holder for carrying the light source.

the low-temperature part and the lamp holder are integrally formed.

the invention also provides a freezer, including the freezer frame mentioned above.

Technical effect of the invention:

The freezer frame and the freezer of the present invention use the heat of the light source for lighting to heat the panel to prevent the panel from fogging and generating condensed water, prevent the freezer door and frame from freezing, and simplify the structure to reduce energy consumption and manufacturing costs.

BRIEF DESCRIPTION OF THE DRAWINGS

The following describes embodiments of the present invention with reference to the accompanying drawings, in which.

DETAILED DESCRIPTION OF THE INVENTION

Hereinafter, specific embodiments of the present invention will be described in further detail based on the drawings. It should be understood that the description of the embodiments of the present invention is not intended to limit the protection scope of the present invention.

Embodiment 1

Figure 1:
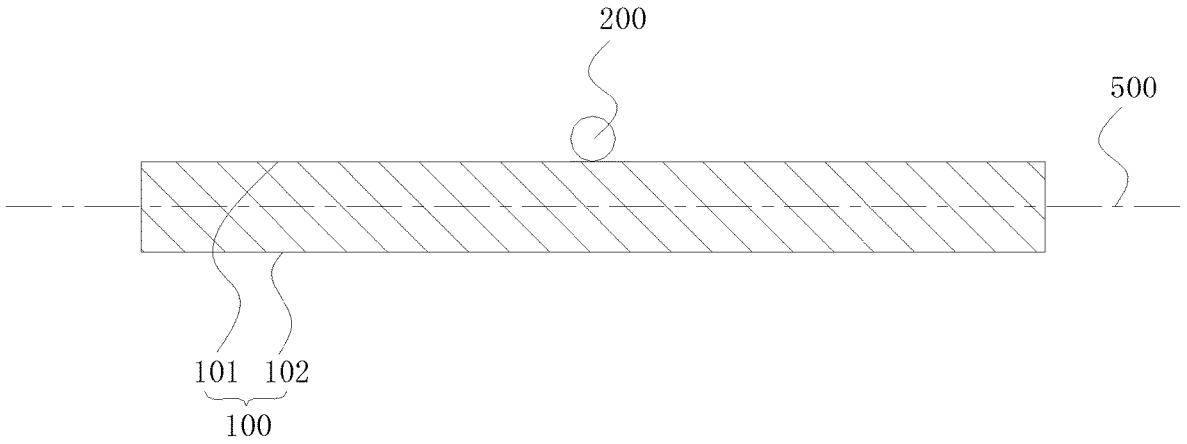
FIG. 1 is a schematic structural diagram of a freezer frame in embodiment 1.

As shown in FIG.1, the freezer frame of this embodiment includes a frame body 100 including a low-temperature part 101 and a heating part 102, and a panel installed in cooperation with the frame is provided on the heating part 102, a light source 200 is provided on the low-temperature part 101, and a heat conduction channel is provided between the light source 200 and the heating part 102.

The frame body 100 is used to support the entire freezer. Generally, the main body uses a metal with certain strength, such as steel, and having a similar structure along the length direction. Therefore, a cross-sectional view perpendicular to the length direction will be used for explanation.

When the freezer is used, at least part of the frame body 100 is located inside the freezer and is in contact with the cold air, and this part of the area is defined as the low-temperature part 101. In this embodiment, as the figures shows, a dot dash line 500 divides the inside and outside of the freezer. This embodiment shows the angle between the panels on both sides of the frame is 180°, but the angle can be set according to the position of the frame and the shape of the freezer, and the angle can be 90° or other angles. In order to prevent the panel from fogging and generating condensate, and to prevent the door and frame of the freezer from freezing, the frame body 100 is equipped with a heating part 102 in the area not in contact with the cool air to set up the panel (here the panel also includes the freezer door, and the following panel includes the freezer door), and heat it to avoid the above problems.

The specific position and shape of the heating part 102 can be set according to needs. When cooperating with the freezer door, the heating part 102 is not in direct contact with the cold air, but in direct contact with the freezer door and heats the refrigerator door. In this embodiment, the contact surface between the heating part 102 and the freezer door is plane. In this embodiment, the frame body 100 adopts thermal conducting material, which can be used as a thermal conducting channel, and the overall structure is more compact. A thermally conductive material can also be additionally provided in the frame body 100 to conduct the heat of the light source 200 to the heating part 102 as a thermally conductive channel. How to achieve thermal conduction is a prior art, which will not be described here.

In order to ensure the heating reliability of the heating section 102, a heating device can be added, for example, an electric heating wire is added on the heating section 102.

In order to realize the lighting inside the freezer, a light source 200 is provided on the low-temperature part 101, and the heat generated by the light source 200 is conducted to the heating part 102 through the heat conduction channel to heat the panel.

The connection method of the heating part 102 and the panel is set according to needs, which can be fixed or detachable, such as clamping, inserting, fastener connection, etc. The heating method is generally realized by heat conduction, which is an existing technology and will not be described here.

The light source 200 can take many forms. In order to save energy and protect the environment, in this embodiment, an LED light source is used, and the light source 200 includes a circuit board and LED chips provided on the circuit board. In order to achieve light distribution, a lens is generally set at the light emitting position of the LED chip. The structure of the lens is selected according to the light distribution needs.

In this embodiment, the heat of the light source 200 mounted on the frame is used to heat the panel, and there is no need to install a heating device or reduce the power of the heating device, so as to simplify the freezer structure and reduce energy consumption.

Embodiment 2

Figure 2:
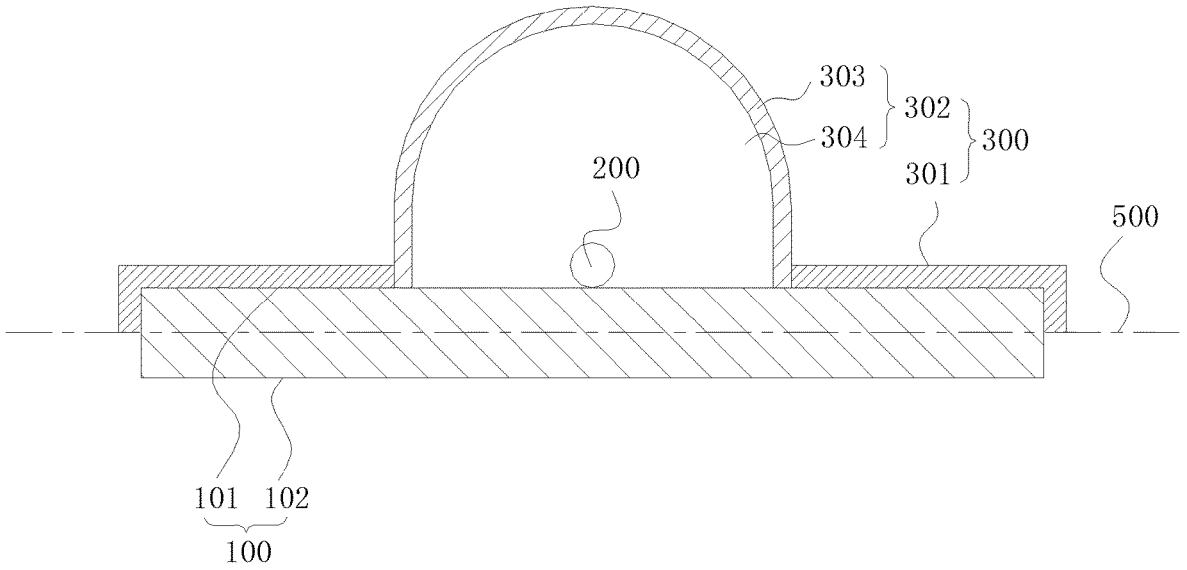
FIG. 2 is a schematic structural diagram of a freezer frame of embodiment 2.

As shown in FIG. 2, in this embodiment, the structure is the same as that of embodiment 1 except for the addition of the heat insulating part 300.

In order to prevent the heat energy of the light source 200 from being dissipated to areas other than the heating part 102, in this embodiment, the frame further includes a heat insulation part 300 provided on the frame body 100. The heat insulation part 300 uses a material with low thermal conductivity. Preferably, the heat insulation part 300 includes a low-temperature and heat-insulating member 301 covering at least part of the low-temperature part 101. Advantageously, the low-temperature and heat-insulating member 301 covers all exposed areas of the low-temperature part 101. In order to prevent the heat of the light source 200 from directly diffusing into the cold air, the heat insulation part 300 further includes a light-transmitting and heat-insulating member 302 located in the light emitting direction of the light source 200.

In this embodiment, the heat insulation part 300 is composed of heat insulation materials and/or heat insulation spaces. The heat insulation materials are classified into three types of porous materials, heat reflective materials and vacuum materials. The former uses the pores contained in the material itself for thermal insulation, because the thermal conductivity of the air or inert gas in the voids is very low, such as foam materials, fiber materials, etc.; vacuum insulation materials use the internal vacuum of the material to block convection for heat insulation. Therefore, common thermal insulation materials include foam plastic, ultra-fine glass wool, high-silicon wool, and vacuum insulation boards. In addition, aerogel blanket is a new type of thermal insulation material, which is a porous material with nanometer pore size, which is mostly used for pipeline insulation and equipment insulation. The thermal conductivity of this material is 0.018 W/(K·m) at normal temperature. It can reach 0.009 W/(K·m) at low temperature.

Vacuum heat insulation board is the latest heat insulation material, which is mostly used in the home appliance industry. The thermal conductivity of this material is extremely low, which is only 0.004. Therefore, the effect of thermal insulation and energy saving is outstanding. At present, domestic refrigerators and refrigerated containers have completely used this material. The Naki thermal insulation felt is a soft industrial thermal insulation material with extremely high thermal insulation performance.

In this embodiment, in order to further improve the heat insulation effect of the light-transmitting and heat-insulating member 302, the light-transmitting and heat-insulating member 302 includes a light-transmitting cover 303 disposed upon the light source 200 and a heat insulation space 304 between the light-transmitting cover 303 and the light source 200. The heat insulation space 304 is generally filled with air, and can be filled with other gases after sealing or evacuated as needed to improve the heat insulation effect. In this embodiment, the light-transmitting and heat-insulating member 302 is directly disposed on the low-temperature part 101.

Embodiment 3

Figure 3:
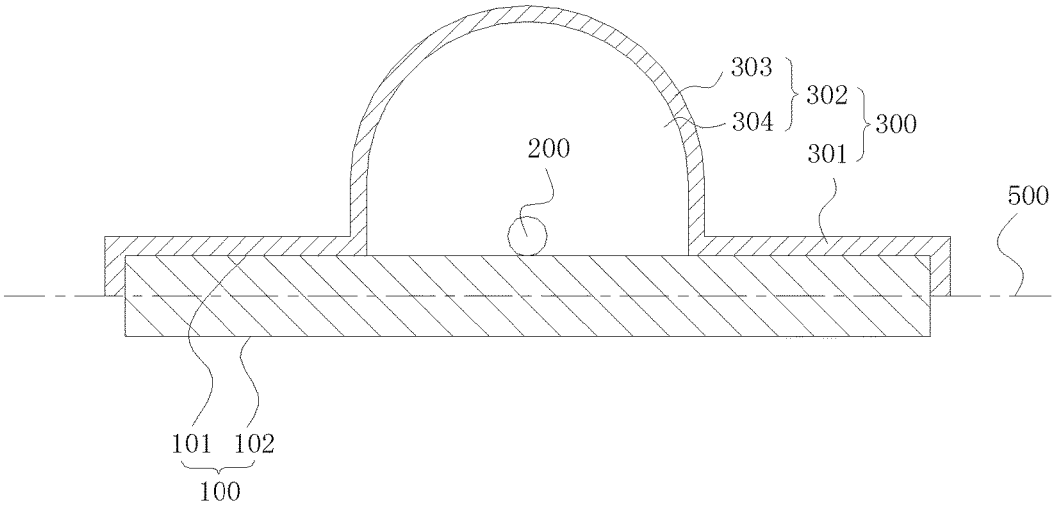
FIG. 3 is a schematic structural diagram of a freezer frame in embodiment 3.
Figure 4:
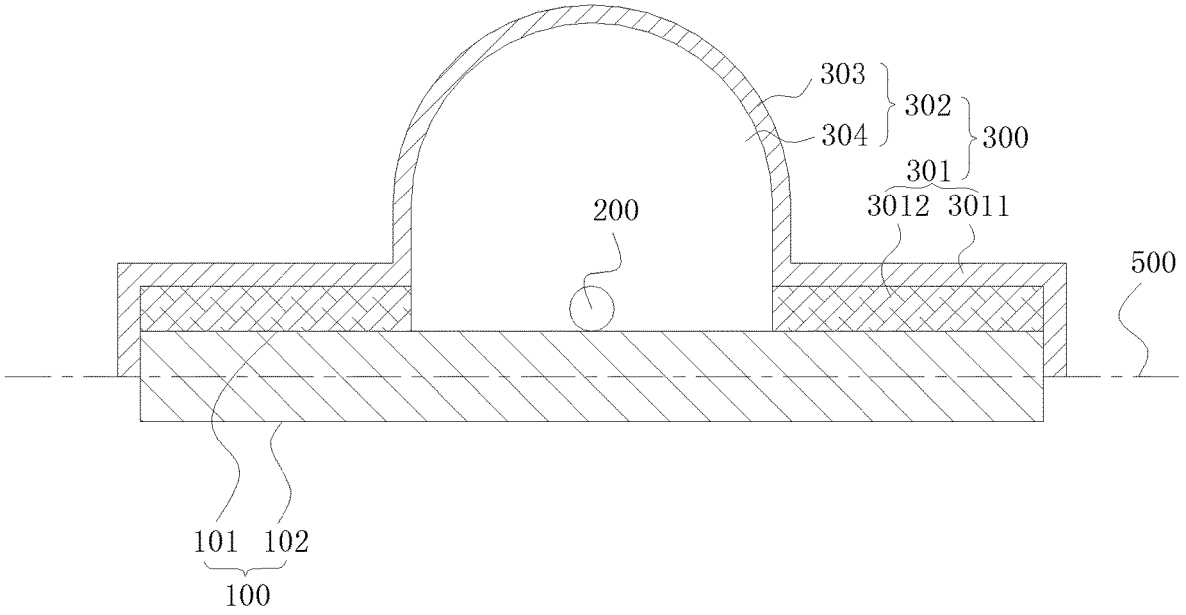
FIG. 4 is a schematic structural diagram of another form of a freezer frame in embodiment 3.

As shown in FIG. 3 and FIG. 4, in this embodiment, the structure is the same as that of embodiment 2 except that the positions of the light-transmitting and heat-insulating members 302 are different.

In this embodiment, in order to improve the heat insulation effect of the heat insulation part 300, the light-transmitting and heat-insulating member 302 is directly disposed on the low-temperature and heat-insulating member 301. Further, the light-transmitting cover 303 and the low-temperature and heat-insulating member 301 are integrally formed and manufactured.

The low-temperature and heat-insulating member 301 includes a heat insulating plate 3011 provided on the low-temperature part 101.

The heat insulating plate 3011 is spaced apart from the low-temperature part 101, and the space between them is filled with porous material 3012, such as the above-mentioned foam material or fiber material.

Embodiment 4

Figure 5:
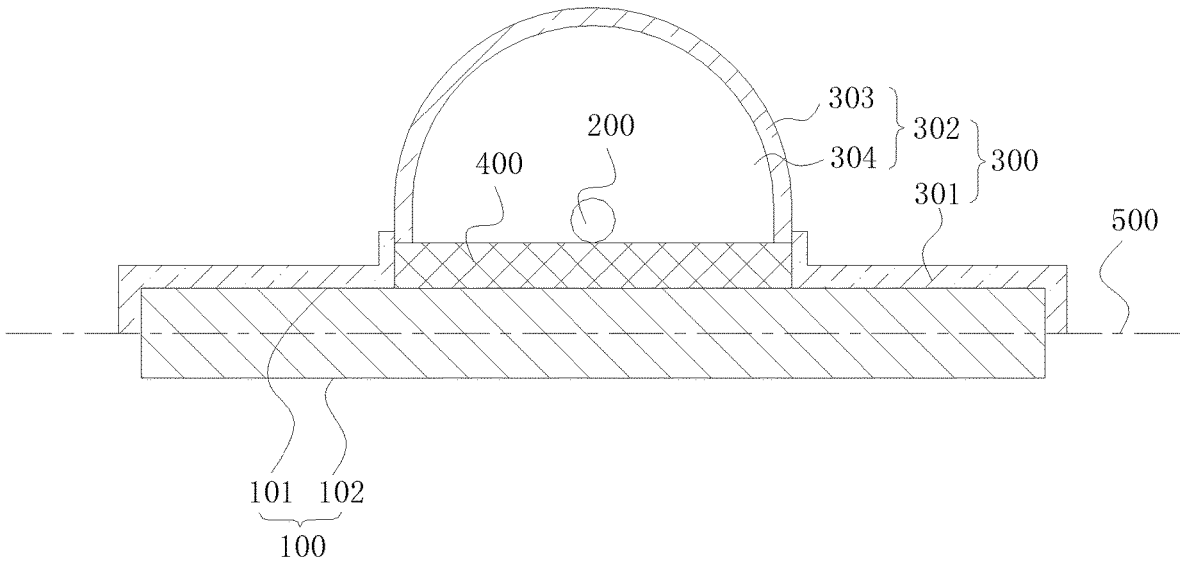
FIG. 5 is a schematic structural diagram of a freezer frame of embodiment 4.

As shown in FIG. 5, the structure of this embodiment is the same as that of embodiment 2 except that a lamp holder 400 is added.

Since the light source 200 generally needs to be carried by the lamp holder, and the material of the lamp holder and the material of the frame body are generally inconsistent, although the frame body can also be used as a lamp holder, in many cases, it is necessary to additionally install a lamp holder. In this embodiment, the low-temperature part 101 is provided with a lamp holder 400 for carrying the light source 200.

However, in embodiments 1 to 3, the low-temperature part 101 and the lamp holder 400 are integrally formed, and the lamp holder 400 is omitted.

Embodiment 5

Figure 6:
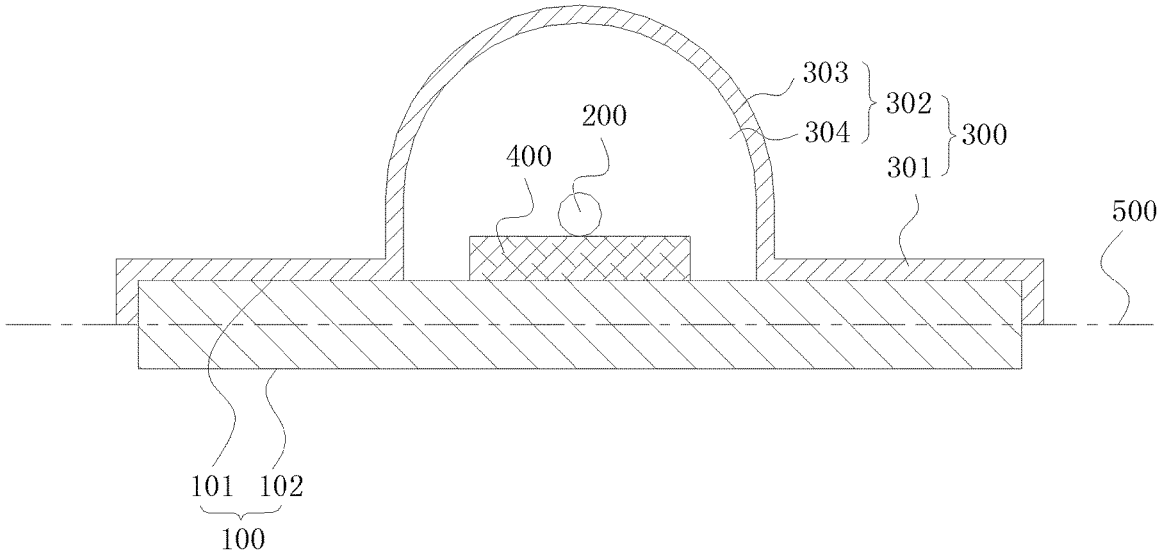
FIG. 6 is a schematic structural diagram of a freezer frame in embodiment 5.

As shown in FIG. 6, in this embodiment, the structure is the same as that of embodiment 4 except that the position of the light-transmitting and heat-insulating 302 is different.

In this embodiment, in order to improve the heat insulation effect of the heat insulation part 300, the light-transmitting and heat-insulating member 302 is directly disposed on the low-temperature and heat-insulating member 301. Further, the light-transmitting cover 303 and the low-temperature and heat-insulating member 301 are integrally formed and manufactured.

Embodiment 6

Figure 7:
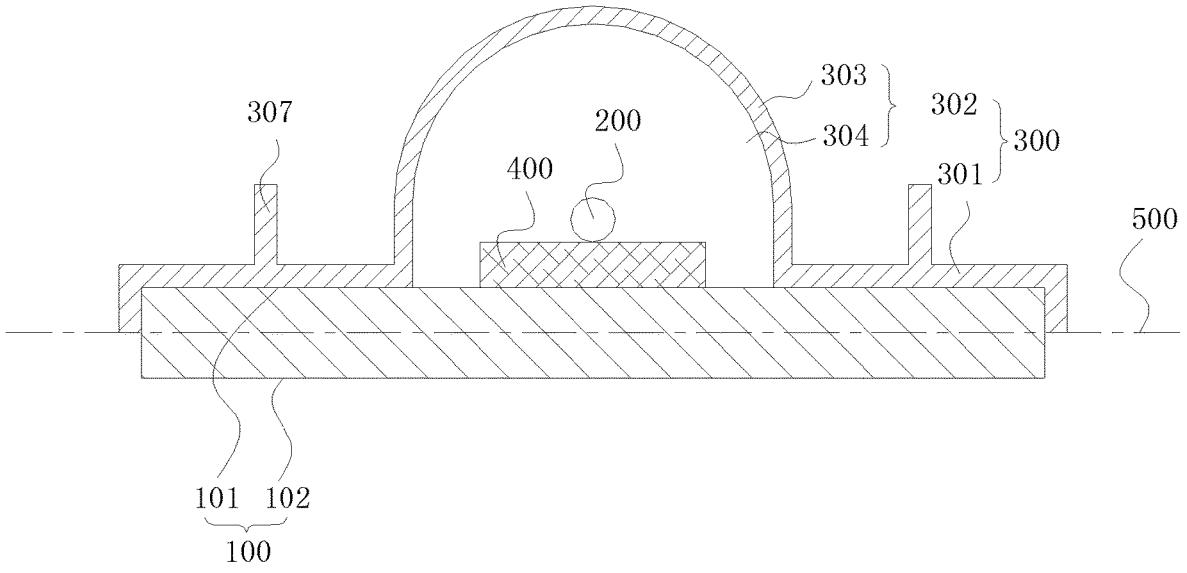
FIG. 7 is a schematic structural diagram of a freezer frame in embodiment 6.

As shown in FIG. 7, in this embodiment, the structure is the same as that of embodiment 5 except for the low-temperature and heat-insulating member 301.

In order to prevent the light source 200 from causing glare, the outer surface of the low-temperature and heat-insulating member 301 can be provided with a light shield 307 located on the periphery of the light source 200.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A freezer frame comprising:

a frame body (100), the frame body (100) includes a low-temperature part (101) and a heating part (102), a panel installed in cooperation with the frame is provided on the heating part (102), characterized in that, a light source (200) is provided on the low-temperature part (101), and a heat conduction channel is provided between the light source (200) and the heating part (102), a low-temperature and heat-insulation member installed on the frame body, and a light-transmitting and heat-insulating member with a semi-circular shape covering the light source, wherein the low-temperature and heat-insulation member and light-transmitting and heat-insulating member are joined into one single piece.

2. The freezer frame as claimed in claim 1, wherein the light-transmitting and heat-insulating member (302) is disposed on the low-temperature part (101).

3. The freezer frame as claimed in claim 1, wherein the heat insulation part (300) comprises a low-temperature and heat-insulating member (301) covering at least a part of the low-temperature part (101), the light-transmitting and heat-insulating member (302) is disposed on the low-temperature and heat-insulating member (301).

4. The freezer frame as claimed in claim 1, wherein the light-transmitting and heat-insulating member (302) comprises a light-transmitting cover (303) disposed upon the light source (200) and a heat insulation space (304) between the light-transmitting cover (303) and the light source (200).

5. The freezer frame as claimed in claim 1, wherein the outer surface of the low-temperature and heat-insulating member (301) is provided with a light shield (307) located on the periphery of the light source (200).

6. The freezer frame as claimed in claim 1, wherein the light-transmitting and heat-insulating member (302) comprises a light-transmitting cover (303) disposed upon the light source (200) and a heat insulation space (304) between the light-transmitting cover (303) and the light source (200).

7. The freezer frame as claimed in claim 1, wherein the low-temperature part (101) is provided with a lamp holder (400) for carrying the light source (200).

8. A freezer comprising the freezer frame as claimed in claim 1.

9. The freezer frame as claimed in claim 1, wherein the low-temperature and heat-insulating member (301) comprises a heat insulating plate (3011) provided on the low-temperature part (101).

10. The freezer frame as claimed in claim 9, wherein the heat insulating plate (3011) is spaced apart from the low-temperature part (101), and the space between them is filled with porous material (3012).

11. The freezer frame as claimed in claim 1, wherein the low-temperature part (101) is provided with a lamp holder (400) for carrying the light source (200).

12. The freezer frame as claimed in claim 11, wherein the low-temperature part (101) and the lamp holder (400) are integrally formed.

* * * * *